US008957827B1

(12) United States Patent
Lee et al.

(10) Patent No.: US 8,957,827 B1
(45) Date of Patent: Feb. 17, 2015

(54) ANTENNA STRUCTURE WITH MULTIPLE MATCHING CIRCUITS

(71) Applicants: Tzung-I Lee, San Jose, CA (US); In Chul Hyun, San Jose, CA (US)

(72) Inventors: Tzung-I Lee, San Jose, CA (US); In Chul Hyun, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 241 days.

(21) Appl. No.: 13/627,628

(22) Filed: Sep. 26, 2012

(51) Int. Cl.
*H01Q 1/50* (2006.01)
*H01Q 1/24* (2006.01)

(52) U.S. Cl.
USPC ..... 343/852; 343/700 MS; 343/702

(58) Field of Classification Search
USPC ..... 343/702, 700 MS, 848, 850, 860, 852
See application file for complete search history.

(56) References Cited

U.S. PATENT DOCUMENTS 7,050,010 B2 * 5/2006 Wang et al. ..... 343/702
7,675,469 B2 * 3/2010 Ohba et al. ..... 343/702

* cited by examiner

*Primary Examiner* — Hoang V Nguyen
(74) *Attorney, Agent, or Firm* — Lowenstein Sandler LLP

(57) ABSTRACT

Off-feed matching circuits for antenna structures of user devices and methods of operating the user devices with the off-feed matching circuits are described. Off-feed matching circuits are matching circuits that are positioned on the radiating elements and not on the feed line. One apparatus includes a RF feed coupled to an excitation antenna element of an antenna structure. The antenna structure also includes two radiating antenna elements and two matching circuits, one for each of the radiating antenna elements. The two radiating antenna elements may be conductively coupled to the excitation antenna element or parasitically coupled to the excitation element.

22 Claims, 7 Drawing Sheets

ANTENNA STRUCTURE WITH MULTIPLE MATCHING CIRCUITS

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

The antennas in the electronic devices may operate in multiple resonant modes for different applications or services. For example the user device may operate in resonant modes used by the 3G, or 3rd generation mobile telecommunication systems. The required frequency bands for 3G mobile telecommunication systems may be GSM850/EGSM in low-band and DCS/PCS/WCDMA in high-band. The 3G band is between 824 MHz and 960 MHz. The user device may also operate in resonant modes used by 4G or 4th generation mobile telecommunication systems. For example, Long Term Evolution (LTE) and LTE Advanced (sometimes generally referred to as 4G) may us frequencies as low as 700 MHz. Generally, the antennas in the electronic devices include a single matching circuit to perform impedance matching, so that the antenna can operate in the different resonant modes.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Off-feed matching circuits for antenna structures of user devices and methods of operating the user devices with the off-feed matching circuits are described. Off-feed matching circuits are matching circuits that are positioned on the radiating elements and not on the feed line as done conventionally. One apparatus includes a RF feed coupled to a first element of a multi-band antenna structure. The multi-band antenna structure also includes a second element that is conductively coupled to a first matching circuit and a third element that is conductively coupled to a second matching circuit. Each of the second element and the third element may be conductively coupled to the first element via one of the matching circuits, or parasitically coupled to the first element. The matching circuits are positioned such that the matching circuits are "off" of the feed line (e.g., are not disposed on a feed line coupled between an RF source and the RF feed). By using two different matching circuits and coupling each matching circuit to a different element, the multi-band antenna structure may operate more efficiently in different resonant modes (e.g., in different frequency bands) than when a single matching circuit is used. Using two matching circuits may also allow the multi-band antenna structure to be independently tuned to one band without affecting another band.

The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 1:
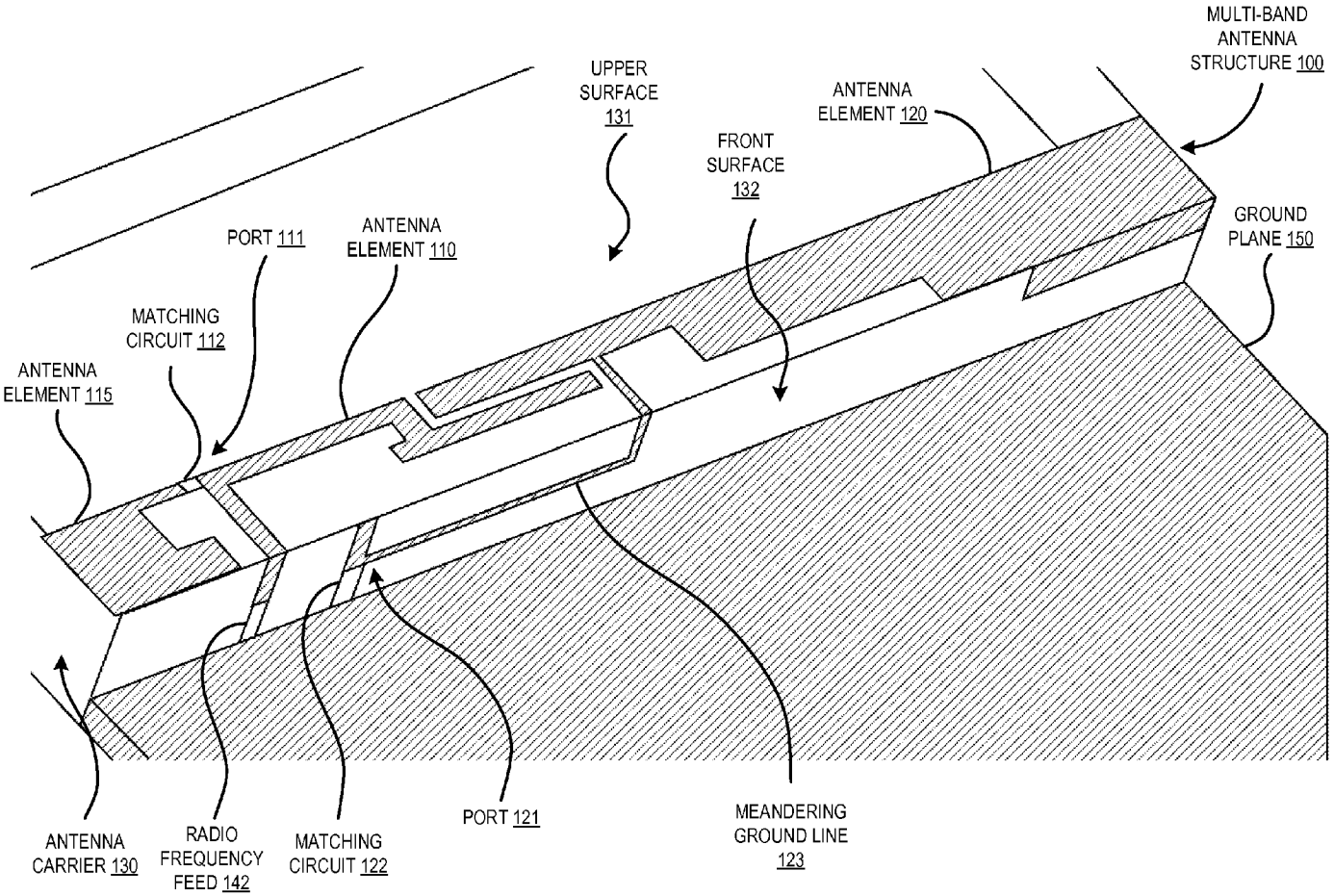
FIG. 1 illustrates one embodiment of a multi-band antenna structure having multiple off-feed matching circuits, coupled to a radio frequency (RF) feed.

FIG. 1 illustrates one embodiment of a multi-band antenna structure 100 having multiple off-feed matching circuits, coupled to a radio frequency (RF) feed 142, according to one embodiment. The multi-band antenna structure 100 may be part of a user device (e.g., part of a smart phone, a tablet computer, an electronic book reader, a laptop computer, etc.). The multi-band antenna structure 100 includes antenna element 110, antenna element 115, and antenna element 120. The multi-band antenna structure 100 is disposed (e.g., positioned or placed) on an antenna carrier 130. The antenna carrier 130 may be a dielectric carrier of the user device. The antenna carrier may be any non-conductive material, such as dielectric material, upon which the conductive material of the multi-band antenna structure 100 can be disposed without making electrical contact with other metal of the user device.

In this embodiment, the multi-band antenna structure 100 is fed at the single RF feed 142 at a first end of the antenna element 110. The first end of antenna element 110 is directly driven by the single RF feed 142. The first end of antenna element 110 is disposed across a front surface 132 of the antenna carrier 130 and wraps onto an upper surface 131 of the antenna carrier 130. The antenna element 110 also includes a bended arm that extends towards the right of the antenna element (away from the RF feed 142) on the upper surface 131 of the antenna carrier 130. In one embodiment, the antenna element 110 may be an excitation antenna element (e.g., an antenna element that does not radiate electromagnetic energy). The antenna element 110 may also be a driven element that is configured to induce a current (e.g., an electrical current), directly or indirectly, on one or more of the antenna elements 115 and 120. In another embodiment, the antenna element 100 may also be a radiating element (e.g., an antenna element configured to radiate electromagnetic energy, such as radio frequency signals, to communicate data). In one embodiment, the antenna element 110 is a folded arm structure, having a first arm and a second arm. The first arm extends from the RF feed 142 until a first bend, and extends from the first bend until a second bend. The second arm includes a second portion that extends from the second bend towards the ground plane 150 until a third bend and extends from the third bend to the side of the antenna carrier 130. The first arm of the antenna element 110 may be used to induce a current on the antenna element 120.

The antenna element 115 is a two-arm antenna. Both arms of the antenna element are pointed towards the antenna element 110 (e.g., towards the RF feed 142). The top arm of the antenna element 115 is conductively coupled (e.g., electrically connected) to the antenna element 110 at port 111 via a matching circuit 112 and a coupling line (not shown in the figures). Because the antenna element 115 is conductively coupled to the antenna element 110 (via the matching circuit 112), the antenna element 110 may directly induce (e.g., conductively induce) a current on the antenna element 115. The antenna element 115 is disposed on the upper surface 131 of the antenna carrier 130. In one embodiment, the antenna element 115 may be a radiating antenna element (e.g., an antenna element configured to radiate electromagnetic energy, such as radio frequency signals, to communicate data).

In one embodiment, the matching circuit 112 provides impedance matching between the antenna element 115 and the single RF feed 142. The matching circuit 112 may include one or more matching components that may be coupled together in various configurations. The matching components may include, but are not limited to, resistors, inductors, capacitors, transmission lines, and tunable matching components such as variable (e.g., tunable) capacitors, a variable (e.g., tunable) switch, variable (e.g., tunable) inductors, etc. The matching circuit 112 may allow the antenna element 115 to operate in multiple resonant modes (e.g., to radiate electromagnetic energy at multiple frequencies) and may improve the efficiency of the antenna element 115 when the antenna element 115 operates in one or more resonant modes. In one embodiment, a modem (e.g., a wireless modem) or a processor may tune or adjust one or more tunable matching components in one or more of the matching circuits 112 and 122. For example, the matching circuit 112 may include a variable capacitor (e.g., a digital capacitor) and the modem or processor may vary the capacitance of the variable capacitor (e.g., send a control signal to the digital capacitor to change the capacitance). In another example, the matching circuit 112 may include different capacitors with different capacitance values. A switch may couple the different capacitors to the antenna element 115. A modem or a processor may send a control signal to the switch indicating which of the different capacitors should be coupled to the antenna element 115. In another embodiment, the modem or processor may tune the tunable matching components or the matching circuit based on a desired resonant mode. For example, the modem or processor may tune matching circuit 112 (e.g., adjust a digital capacitor) such that antenna element 115 operates in a particular resonant mode (e.g., at a particular frequency). In a further embodiment, the matching components in the one or more of the matching circuits 112 and 122 may be static or fixed. For example, the capacitance value of a capacitor in the matching circuit 112 may not be variable (e.g., may not be changed).

The antenna element 120 has a tapered structure. The antenna element 120 is positioned such that the narrower end of the antenna element 120 is pointed towards the antenna element 110 (e.g., towards the RF feed 142) and the wider end of the antenna element 120 pointed towards the right side of the user device (away from the RF feed 142). The wider end of the antenna element includes a section that wraps onto the front surface 132. The antenna element 120 also includes a meandering ground line 123. The meandering ground line 123 has a first portion that extends from the narrower end of the antenna element 120 on the upper surface 131 and wraps down towards the ground plane 150 on the front surface 132. The second portion of the meandering ground line 123 includes a bended arm that extends towards the RF feed 142 and bends up towards the upper surface 131. The meandering ground line 123 of the antenna element 120 is conductively coupled (e.g., electrically connected) to the ground plane 150 at port 121 via a matching circuit 122. In one embodiment, a meandering ground line (e.g., meandering ground line 123) may be a metallic portion and/or metallic member that has a meandering shape. For example, a meandering ground line may be a metallic line or wire that runs from left to right, right to left, up to down, and/or down to up, as the meandering ground line approaches the ground plane 150. In another embodiment, a meandering ground line may include curved portions in addition to straight portions. In a further embodiment, a meandering ground line may be any metallic portion and/or metallic member that is coupled to ground (e.g., ground plane 150) and does not use the shortest path to ground. In one embodiment, the antenna element 120 may be a radiating antenna element (e.g., an antenna element configured to radiate electromagnetic energy, such as radio frequency signals, to communicate data). In one embodiment, the antenna element 120 includes a base portion and a first arm, wherein the first arm extends from the base portion towards the antenna element 110, the first arm is disposed substantially parallel to an arm of the antenna element 110 and in relation to another arm of the antenna element 110 to form a coupling between the antenna element 120 and the antenna element 110.

In one embodiment, the matching circuit 122 provides impedance matching between the antenna element 120 and the single RF feed 142. The matching circuit 122 may include one or more matching components that may be coupled together in various configurations. The matching components may include, but are not limited to, resistors, inductors, capacitors, transmission lines, variable (e.g., tunable) capacitors, a variable (e.g., tunable) switch, variable (e.g., tunable) inductors, etc. The matching circuit 122 may allow the antenna element 120 to operate in multiple resonant modes (e.g., to radiate electromagnetic energy at multiple frequencies or frequency bands) and may improve the efficiency of the antenna element 120 when the antenna element 120 operates in one or more resonant modes.

In the depicted embodiment, the antenna element 120 is a parasitic antenna element. A parasitic antenna element is an element of the multi-band antenna structure 100 that is not driven directly by the single RF feed 142. Rather, the single RF feed 142 directly drives the antenna element 110 of the antenna structure, which parasitically induces a current on the parasitic element (e.g., antenna element 120). The antenna element 120 may be other types of parasitic elements (e.g., a parasitic element that is coupled to ground, such as a parasitic grounding element). In particular, by directly inducing (e.g., by conductively inducing) current on the antenna element 110 by the single RF feed 142, the directly-fed structures radiates causes another current on the antenna element 120 to radiate electromagnetic energy, creating multiple resonant modes. In the depicted embodiment, the antenna element 120 is parasitic because it is physically separated from the antenna element 110 that is driven at the single RF feed 142. It can also be said that the antenna element 120 (e.g., the parasitic element) is not conductively connected to the RF feed 142. The driven antenna element 110 parasitically excites the current flow of the antenna element 120. In one embodiment, the antenna element 120 can be physically separated by one or gaps between antenna element 120 and the antenna element 110. Alternatively, other antenna configurations may be used to include driven antenna elements and a parasitic grounding element.

In one embodiment, the multi-band antenna structure 100 may include a low-band ground line (e.g., antenna element 120) configured to radiate electromagnetic energy in a first resonant mode and a high-band line (e.g., antenna element 115) configured to radiate electromagnetic energy in a second resonant mode. The low-band ground line and the high-band ground line may be physically separated and the first resonant mode and the second resonant mode may be independent from one another. The antenna structure may also include an excitation line (e.g., antenna element 110) coupled to an RF feed line (e.g., RF feed 142) and a matching circuit (e.g., matching circuit 112 or 122) coupled to at least one of the low-band ground line or the high-band ground line. The matching circuit is not disposed on the RF feed line.

In FIG. 1, the ground plane 150 is a radiation ground plane. The ground plane 150 may be a ground plane of a printed circuit board (PCB) or other types of circuit boards. Alternatively, the ground plane 150 may be other metal members and/or metal elements in the user device that are coupled to ground. The RF feed 142 may be a feed line connector that couples the multi-band antenna structure 100 to a feed line (also referred to as the transmission line), which is a physical connection that carriers the RF signal to and/or from the multi-band antenna structure 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to antenna element 110 and antenna element 115 of the multi-band antenna structure 100 (via the matching circuit 112), but is not conductively connected to antenna element 120 of the multi-band antenna structure 100. However, the antenna element 110 is configured to operate as a feeding structure to the antenna element 120.

In another embodiment, portions of the multi-band antenna structure 100 may be disposed on or within a circuit board, such as a PCB. Alternatively, the multi-band antenna structure 100 may be disposed on other components of the user device or within the user device as would be appreciated by one of ordinary skill in the art having the benefit of this disclosure. It should be noted that the multi-band antenna structure 100 illustrated in FIG. 1 is a three-dimensional (3D) structure. For example, portions of the antenna element 110 and the antenna element 120 are disposed on the front surface 132 and the upper surface 131 of the antenna carrier 130. In other embodiments, portions of the multi-band antenna structure 100 may be disposed in different configurations on one or more sides of the antenna carrier 130 as would be appreciated by one of ordinary skill in the art having the benefit of this disclosure. However, as described herein, the multi-band antenna structure 100 may be a planar, two-dimensional (2D), as well as other variations than those depicted in FIG. 1.

The multi-band antenna structure 100 may be configured to provide multiple resonant modes (e.g., to radiate or operate in multiple frequencies). In the depicted embodiment, the multi-band antenna structure 100 may be configured to operate between 700 MHz and 960 MHz in a low band and between 1.71 and 2.7 GHz in a high band. This allows the multi-band antenna structure 100 to operate in one or more of the following frequency bands: LTE 700, LTE 2700, UMTS, GSM 850, GSM 900, GSM 1800 and GSM 1900. In a further embodiment, the multi-band antenna structure 100 is configured to operate in additional frequency bands, such as Global Positioning System (GPS), Bluetooth, wireless local area network (WLAN) (e.g., WiFi), personal area network (PAN), or any combination thereof. Using the antenna element 110, the antenna element 115, the antenna element 120, the matching circuit 112, and the matching circuit 122, the multi-band antenna structure 100 can create multiple resonant modes using the single RF feed 142, such as two or more resonant modes. In one embodiment, the multi-band antenna structure 100 has multiple resonant modes with frequencies between 700 MHz and 2.7 GHz. In another embodiment, the multi-band antenna structure 100 can be configured to create a resonant mode for LTE 700 plus resonant modes for penta-band. In telecommunications, the terms multi-band, dual-band, tri-band, quad-band, and penta-band refer to a device, such as the user device described herein, supporting multiple RF bands used for communication. In other embodiments, the antennas can be designed to cover multiple bands, including LTE/GSM/UMTS, the GSM850/900/1800/1900/UMTS penta-band operation, or the LTE700/GSM850/900 (698-960 MHz) and GSM 1800/190/UMTS/LTE2300/2500 (1710-2690) MHz operation. In the user device context, the purpose of doing so is to support roaming between different regions whose infrastructure cannot support mobile services in the same frequency range. These frequency bands may be UMTS frequency bands, GSM frequency bands, or other frequency bands used in different communication technologies, such as, for example, cellular digital packet data (CDPD), general packet radio service (GPRS), enhanced data rates for GSM evolution (EDGE), 1 times radio transmission technology (1xRTT), evaluation data optimized (EVDO), high-speed downlink packet access (HSDPA), WiFi, WiMax, Bluetooth, etc.

The structure (e.g., 2D, 3D), the dimensions (e.g., height, width, length), shapes, bends, and configurations of the antenna elements 110, 115, and 120 of the multi-band antenna structure 100 may be varied to achieve the desired frequency range as would be appreciated by one of ordinary skill in the art having the benefit of this disclosure, however, the total lengths of the antenna elements are a major factor for determining the frequency, and the lengths or widths of the antenna elements 110, 115, and 120 are a factor for impedance matching. It should be noted that the factors of total length and width are dependent on one another. In one embodiment, the antenna elements 110, 115, and 120 may be any combination of one or more of a monopole antenna, a T-monopole antenna, a loop antenna, a dipole antenna, an inverted-F antenna, and a planar inverted-F antenna.

Figure 2:
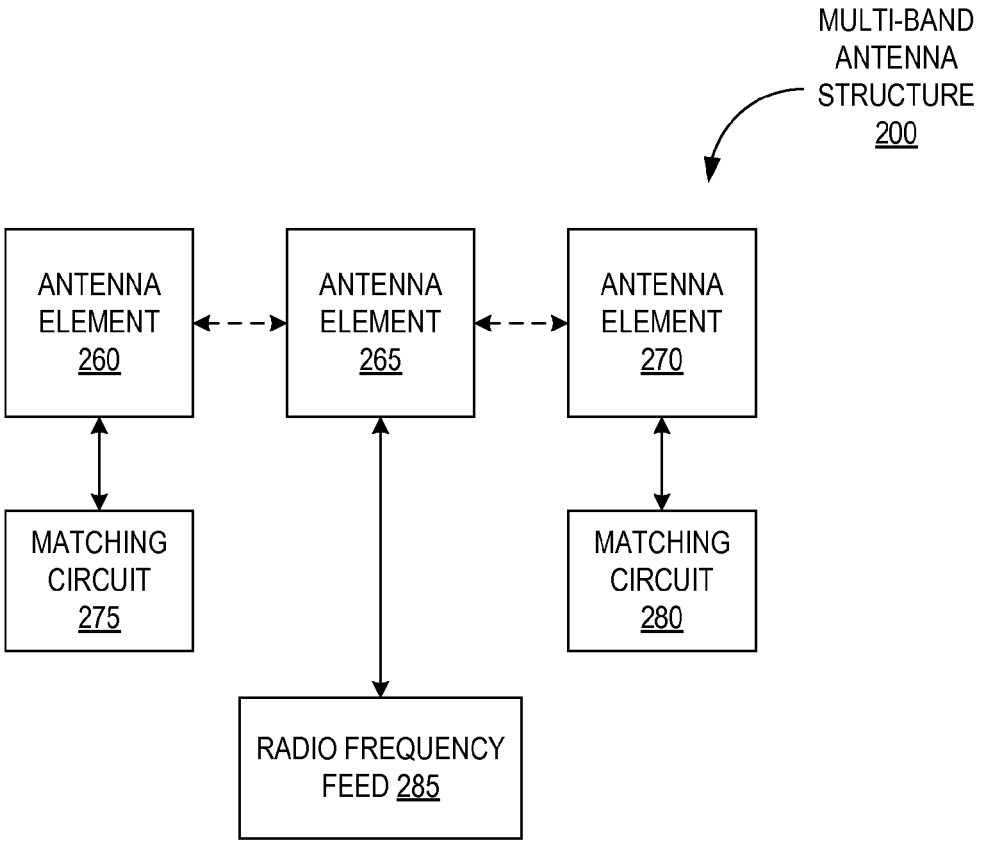
FIG. 2 is a block diagram illustrating a multi-band antenna structure, according to another embodiment.

FIG. 2 is a block diagram illustrating a multi-band antenna structure 200, according to one embodiment. The multi-band antenna structure 200 includes antenna elements 260, 265, and 270, and matching circuits 275 and 280. The multi-band antenna structure 200 is fed at the single RF feed 285. The RF feed 285 may be a feed line connector that couples the multi-band antenna structure 200 to a feed line (also referred to as the transmission line), which is a physical connection that carriers the RF signal to and/or from the multi-band antenna structure 200. The feed line connector may be any one of the three common types of feed lines, including coaxial feed lines, twin-lead lines or waveguides. Alternatively, other types of connectors can be used.

The antenna element 265 is directly driven by the single RF feed 285. In one embodiment, the antenna element 265 may be an excitation antenna element (e.g., an antenna element that does not radiate electromagnetic energy, or a driven element that induces a current onto other antenna elements). In another embodiment, the antenna element 265 may also be a radiating element (e.g., an antenna element that radiates electromagnetic energy). The antenna element 265 may be configured to induce a current (e.g., an electrical current), directly or indirectly, on one or more of the antenna elements 260 and 270. The antenna elements 260 and 270 may each be conductively coupled (e.g., electrically connected to) the antenna element 265 or parasitically coupled to antenna element 265. For example, antenna elements 260 and 270 may both be conductively coupled (e.g., electrically connected to) to antenna element 265, may both be parasitically coupled to the antenna element 265, or one of the antenna elements 260 and 270 may be conductively coupled to antenna element 265 and the other may be parasitically coupled to antenna element 265. In one embodiment, the antenna elements 260 and 270 may be radiating antenna elements (e.g., an antenna element configured to radiate electromagnetic energy, such as radio frequency signals, to communicate data). The antenna element 260 may be configured to operate in a first resonant mode (e.g., radiate electromagnetic energy in low-band frequencies such as frequencies between 700 MHz and 960 MHz). The antenna element 270 may be configured to operate in a second resonant mode (e.g., radiate electromagnetic energy in high-band frequencies such as frequencies between 1.7 GHz and 2.7 GHz). In one embodiment, the antenna elements 260 and 270 may be configured to operate (e.g., radiate electromagnetic energy) in more than one resonant mode. For example, antenna elements 260 and 270 may each operate in two resonant modes. In another example, the antenna element 260 may operate in one resonant mode and the antenna element 270 may operate in two resonant modes.

The multi-band antenna structure 200 may provide a matching network for impedance matching, according to one embodiment. The matching network may include a matching circuit 275 and a matching circuit 280. Each of the matching circuits 275 and 280 may include may include one or more matching components (e.g., capacitors, inductors, etc.) that may be coupled together in various configurations. The matching circuit 275 may provide impedance matching between the antenna element 260 and the RF feed 285. The matching circuit 280 may provide impedance matching between the antenna element 270 and the RF feed 285. The matching circuits 275 and 280 may allow the multi-band antenna structure 200 to operate in multiple resonant modes and may improve the efficiency of the multi-band antenna structure 200 when the multi-band antenna structure 200 operates in one or more resonant modes. The matching circuits 275 and 280 are positioned on the radiating elements (e.g., antenna elements 260 and 270) of the multi-band antenna structure 200 or "off" the feed line (e.g., are not positioned between the antenna and the RF feed).

Because the multi-band antenna structure 200 includes two matching circuits 275 and 280, the efficiency of the multi-band antenna structure 200 may be improved when the multi-band antenna structure 200 operates in different resonant modes. The first matching circuit 275 may allow the multi-band antenna structure 200 to operate more efficiently in a first resonant mode (e.g., in low-band frequencies, such as frequencies between 700 MHz and 960 MHz). The second matching circuit 280 may allow the multi-band antenna structure 200 to operate more efficiently in a second resonant mode (e.g., in high-band frequencies, such as frequencies between 1.7 GHz and 2.7 GHz). By using two different matching circuits 275 and 280, the multi-band antenna structure 200 may use different matching components in each of the matching circuits 275 and 280. The different matching components of the matching circuits 275 and 280 may allow matching circuits 275 and 280 to tune the antenna elements 260 and 270 more efficiently. For example, the matching circuit 275 may include a first set of matching components that are configured to tune the antenna element 260 to operate more efficiently in the first resonant mode (e.g., low-band frequencies). The second matching circuit 280 may include a second, different set of matching components that are configured to tune the antenna element 270 to operate more efficiently in a second resonant mode (e.g., high-band frequencies). By using two matching circuits 275 and 280 (instead of using one matching circuit to tune the multi-band antenna structure 200 as illustrated by multi-band antenna 200), the multi-band antenna structure 200 is able to operate efficiently across multiple resonant modes, when compared to a conventional multi-band antenna that use a traditional matching network (e.g., a single matching circuit positioned between an RF feed and the antenna) for impedance matching. Because a traditional matching network uses a single matching circuit, the matching circuit may operate efficiently in one resonant mode but not operate efficiently in another resonant mode, or may not operate efficiently in either resonant mode (e.g., the single matching circuit may be configured to designed to provide impedance matching for a broad range of resonant modes, rather then provide more efficient impedance matching for certain resonant modes).

The efficiency of the multi-band antenna structure 200 can be tuned for specified target bands. For example, the target band can be Verizon LTE band and the GSM850/900 band, and the multi-band antenna structure 200 can be tuned to optimize the efficiency for this band as well as for other bands, such as DCS, PCS and WCDMA bands. The efficiency of the multi-band antenna structure may be optimized in different bands by selecting or configuring the two matching circuits based on the different bands. For example, the first matching circuit may be selected or configured to increase the efficiency of the multi-band antenna structure 200 for low-band frequencies, and the second matching circuit may be selected or configured to increase the efficiency of the multi-band antenna structure 200 for high-band frequencies. The efficiency of the multi-band antenna structure may also be optimized by adjusting dimensions of the 3D structure, the gaps between the elements of the structure, a distance between the RF feed 285 and the grounding points at a ground plane, or any combination thereof. Similarly, 2D structures can be modified in dimensions and gaps between elements to improve the efficiency in certain frequency bands as would be appreciated by one of ordinary skill in the art having the benefit of this disclosure. It should also be noted that the antennas described herein may be implemented with two-dimensional geometries, as well as three-dimensional geometries as described herein.

Although two matching circuits and three antenna elements are shown in the multi-band antenna structure 200, in other embodiments, the multi-band antenna structure 200 may include more than two matching circuits and more than three antenna elements. For example, the multi-band antenna structure 200 may include three matching circuits and four antenna elements. In another example, the multi-band antenna structure 200 may include four matching circuits and six antenna elements. In addition, as discussed above, the structure (e.g., 2D, 3D), the dimensions (e.g., height, width, length), shapes, bends, and configurations of the antenna elements of the multi-band antenna structure 200 may be varied to achieve the desired frequency range as would be appreciated by one of ordinary skill in the art having the benefit of this disclosure. The matching components of the matching circuits 275 and 280 may also be configured or selected to tune the antenna elements 260 and 270, based on the structure, shape, or configurations of the antenna elements 260 and 270. This may allow more flexibility when designing the multi-band antenna (e.g., when designing the structure, shape, etc., of the antenna elements) because the matching circuits 275 and 280 may each be selected, configured, or designed to tune the antenna elements 260 and 270, based on the structure or shape of the antenna elements 260 and 270.

Figure 3:
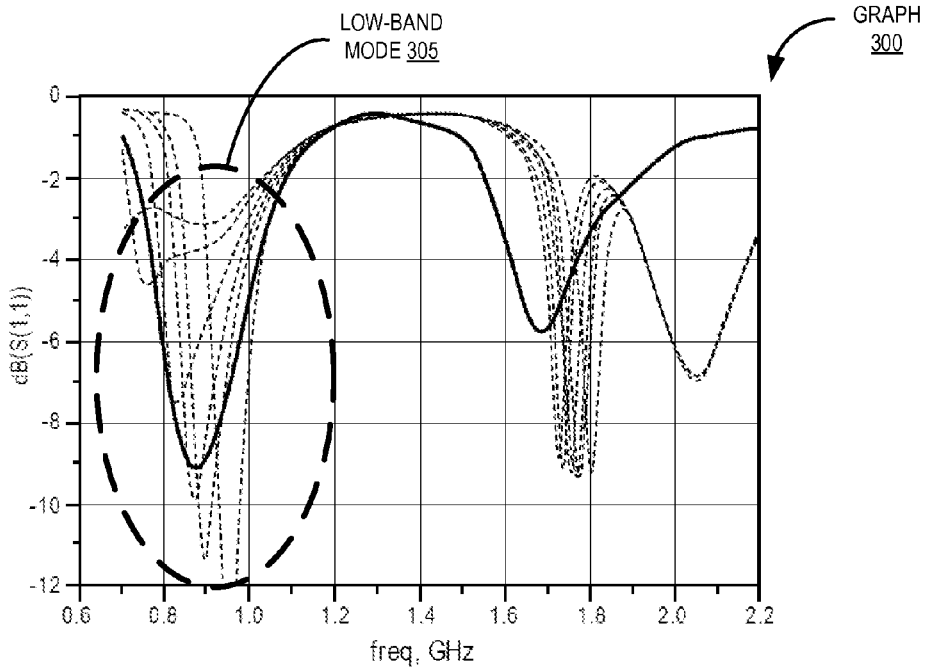
FIG. 3 is a graph of measured reflection coefficient of the multi-band antenna structure of FIG. 1 in a low-band mode, according to one embodiment.

FIG. 3 is a graph 300 of multiple measured reflection coefficients of the multi-band antenna structure 100 of FIG. 1, according to one embodiment. The graph 300 shows the different measured reflection coefficients (also referred to S-parameter or |S 1 1|) of the multi-band antenna structure 100 of FIG. 1 when the multi-band antenna structure 100 operates in low-band mode 305, for different matching circuit configurations. The solid line represents the measured reflection coefficient for when the multi-band antenna structure 100 uses a traditional matching network (e.g., uses a signal matching circuit coupled to the RF feed). The dotted lines represent the different measured reflection coefficients when the multi-band antenna structure 100 uses two matching circuits. Each dotted line represents the measured reflection coefficient when different types of matching components (e.g., capacitors with different values, inductors with different values, etc.) are used in the two matching circuits. The multi-band antenna structure 100 may cover approximately 700 MHz to 960 MHz in the low-band mode. As described herein, other resonant modes may be achieved.

In one embodiment, the multi-band antenna structure 100 can be configured for the LTE (700/2600), UMTS, GSM (850, 800, 1800 and 1900), GPS, Wi-FI, and Bluetooth frequency bands. In effect, the multi-band antenna structure 100 has frequencies between 700 MHz to 2.7 GHz. Using the embodiments described herein with the antenna structure, the reflection coefficients (e.g., the return loss) is reduced over 700 MHz to 2.7 GHz frequency range. Hence, the embodiments described herein can be utilized in any application in the frequency range, like LTE (700/2600), UMTS, GSM (850, 900, 1800 and 1900), GPS and Wi-Fi/Bluetooth. In another embodiment, the multi-band antenna structure 100 can be designed to operate in the following target bands: 1) Verizon LTE band: 746 to 787 MHz; 2) US GSM 850: 824 to 894 MHz; 3) GSM900: 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. These resonance bandwidths may be characterized by VNA measurements with about 6 dB bandwidth (BW). Alternatively, the multi-band antenna structure 100 can be designed to operate in different combinations of frequency bands as would be appreciated by one of ordinary skill in the art having the benefit of this disclosure. Alternatively, the multi-band antenna structure 100 can be configured to be tuned to other frequency bands as would be appreciated by one of ordinary skill in the art having the benefit of this disclosure.

Figure 4:
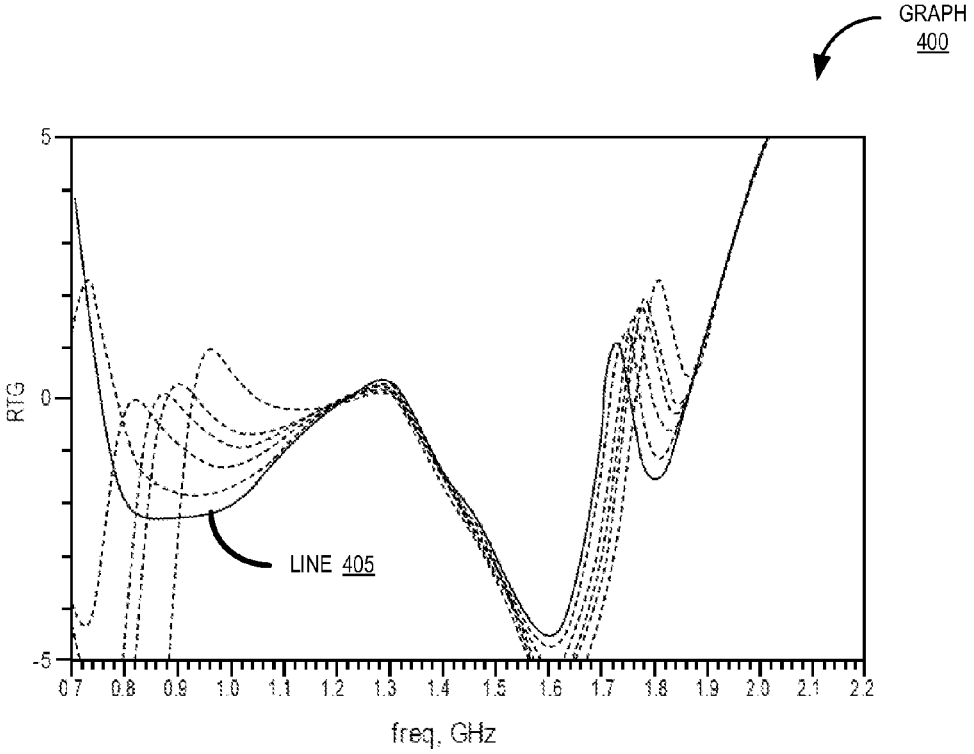
FIG. 4 is a graph of the relative transducer gain of the multi-band antenna structure of FIG. 1 in the low-band mode shown in FIG. 3, according to one embodiment.

FIG. 4 is a graph 400 of the relative transducer gain of the multi-band antenna structure 100 of FIG. 1 in the low-band mode 305 shown in FIG. 3, according to one embodiment. The graph 400 illustrates the relative value in transducer gains (in terms of decibels (dB) on the y-axis of the graph 400) for different frequencies (in terms of Gigahertz (GHz) on the x-axis of the graph 400) when different types of matching networks are used. The relative transducer gain (RTG) is relative to the solid line in the low-band mode 305 shown in FIG. 3. Each of the lines in the graph 400 represents the relative transducer gain when different types of matching components (e.g., capacitors with different values, inductors with different values, etc.) are used in the two matching circuits.

Figure 5:
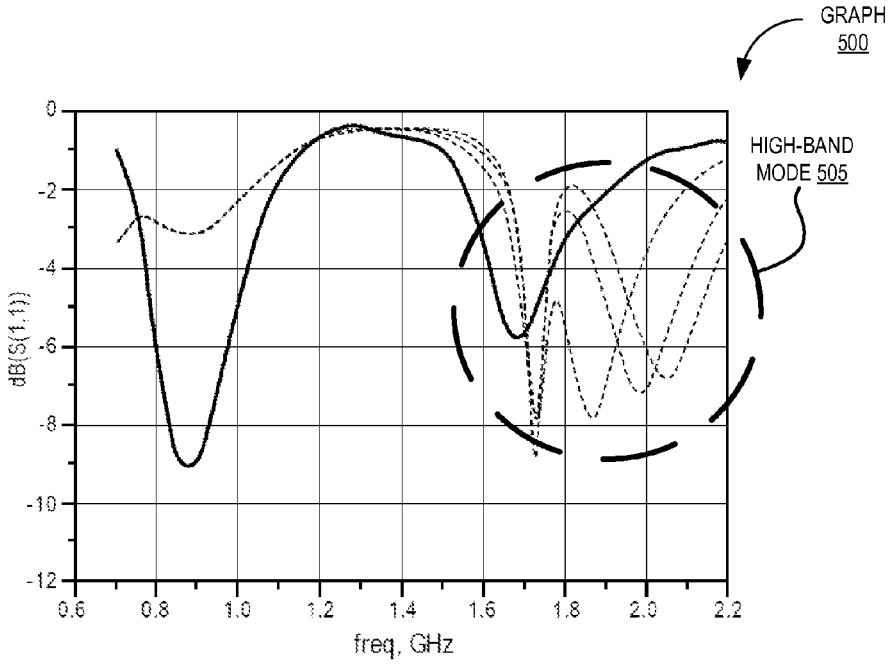
FIG. 5 is a graph of measured reflection coefficient of the multi-band antenna structure of FIG. 1 in a high-band mode, according to another embodiment.

FIG. 5 is a graph 500 of measured reflection coefficient of the multi-band antenna structure 100 of FIG. 1, according to another embodiment. The graph 500 shows the different measured reflection coefficients (also referred to S-parameter or |S 1 1|) of the multi-band antenna structure 100 of FIG. 1 when the multi-band antenna structure 100 operates in high-band mode 505, for different matching circuit configurations. The solid line represents the measured reflection coefficient for when the multi-band antenna structure 100 uses a traditional matching network (e.g., uses a signal matching circuit coupled to the RF feed). The dotted lines represent the different measured reflection coefficients when the multi-band antenna structure 100 uses two matching circuits. Each dotted line represents the measured reflection coefficient when different types of matching components (e.g., capacitors with different values, inductors with different values, etc.) are used in the two matching circuits. The multi-band antenna structure 100 covers approximately 1.71 GHz to 2.7 GHz in the high-band mode. As described herein, other resonant modes may be achieved.

Figure 6:
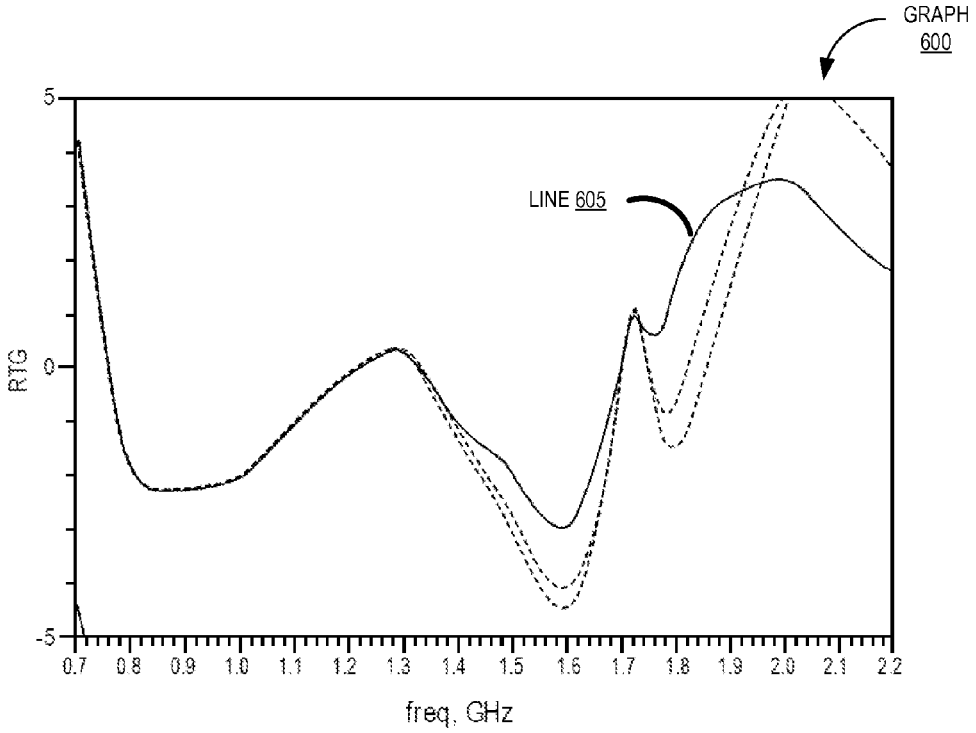
FIG. 6 is a graph of the relative transducer gain of the multi-band antenna structure of FIG. 1 in the high-band mode shown in FIG. 5, according to another embodiment.

FIG. 6 is a graph 600 of the relative transducer gain of the multi-band antenna structure 100 of FIG. 1 in the high-band mode 505 shown in FIG. 5, according to another embodiment. The graph 600 illustrates the relative value in transducer gains (in terms of dB on the y-axis of the graph 600) for different frequencies (in terms of GHz on the x-axis of the graph 600) when different types of matching networks are used. The relative transducer gain (RTG) is relative to the solid line in the high-band mode 505 shown in FIG. 5. Each of the lines represent the relative transducer gain when different types of matching components (e.g., capacitors with different values, inductors with different values, etc.) are used in the two matching circuits.

Figure 7:
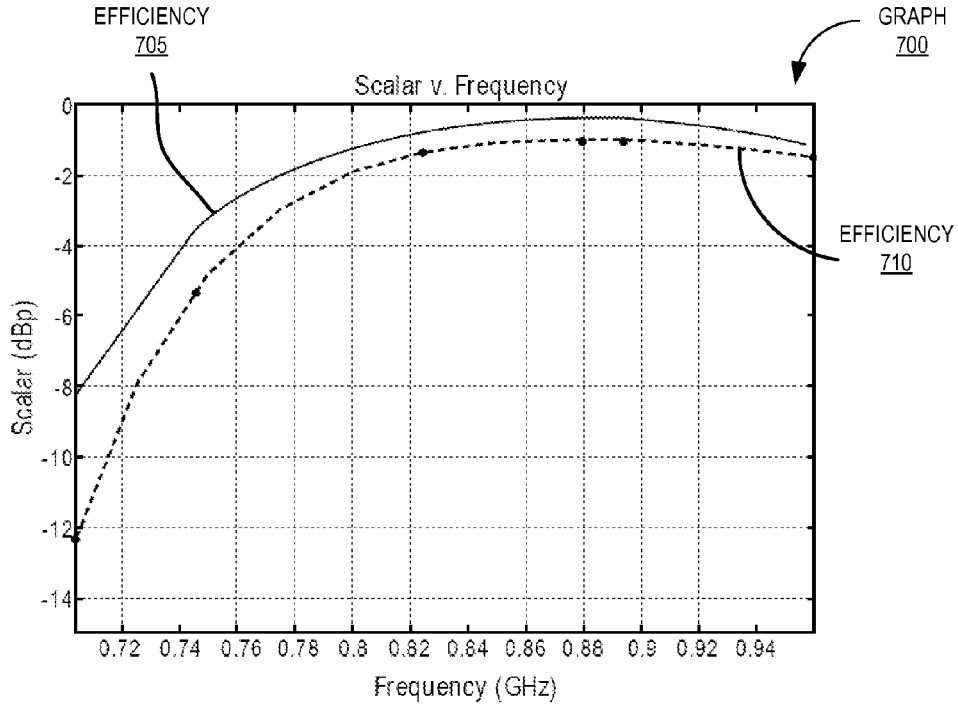
FIG. 7 is a graph of efficiencies of the multi-band antenna structure of FIG. 1 in a low-band mode, according to one embodiment.

FIG. 7 is a graph 700 of efficiencies of the multi-band antenna structure 100 of FIG. 1 in low-band, according to one embodiment. The total efficiency of the antenna can be measured by including the loss of the structure and mismatch loss. The graph 700 shows the first efficiency 705 for the multi-band antenna structure 100 when the multi-band antenna structure 100 uses two matching circuits, and the measured efficiency 710 of the multi-band antenna structure 100 when the multi-band antenna structure 100 uses the traditional, single matching circuit, for a frequency range between 700 MHz and 980 Mhz. As shown in FIG. 7, the multi-band antenna structure 100 is more efficient when two matching circuits are used, versus the traditional single matching circuit. The efficiencies 705 and 710 are the efficiencies of the antenna structure's efficiencies at free space (FS).

Figure 8:
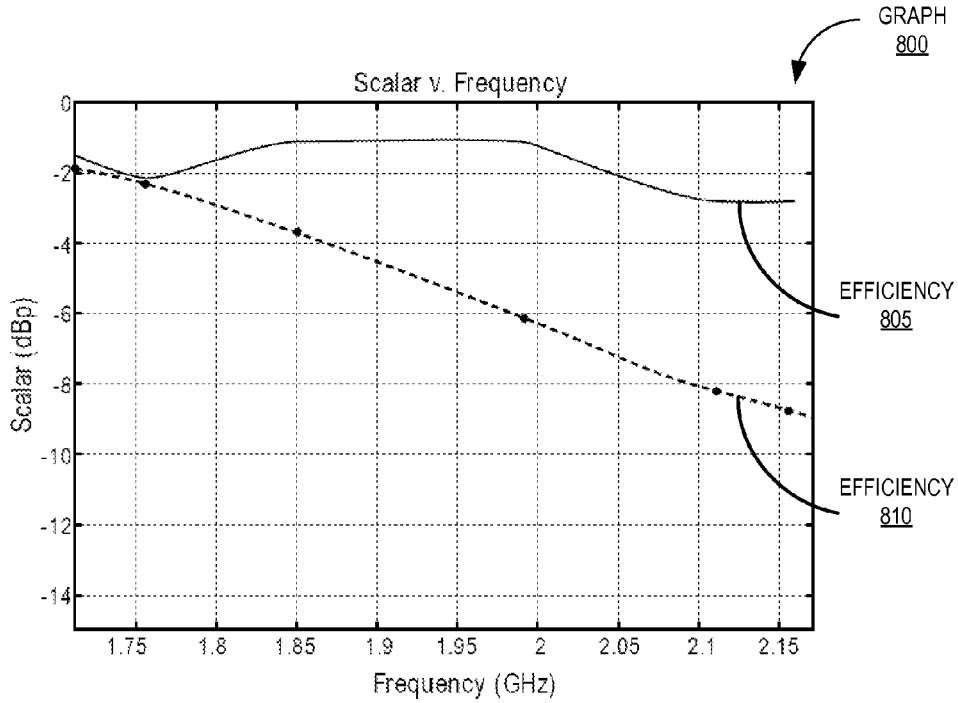
FIG. 8 is a graph of efficiencies of the multi-band antenna structure of FIG. 1 in a high-band mode, according to another embodiment.

FIG. 8 is a graph 800 of efficiencies of the multi-band antenna structure 100 of FIG. 1 in high-band, according to another embodiment. The total efficiency of the antenna can be measured by including the loss of the structure and mismatch loss. The graph 800 shows the first efficiency 805 for the multi-band antenna structure 100 when the multi-band antenna structure 100 uses two matching circuits, and the measured efficiency 810 of the multi-band antenna structure 100 when the multi-band antenna structure 100 uses the traditional, single matching circuit, for a frequency range between 1.7 GHz and 2.2 GHz. As shown in FIG. 8, the multi-band antenna structure 100 is more efficient when two matching circuits are used, versus the traditional single matching circuit. The efficiencies 805 and 810 are the efficiencies of the antenna structure's efficiencies at free space (FS).

Figure 9:
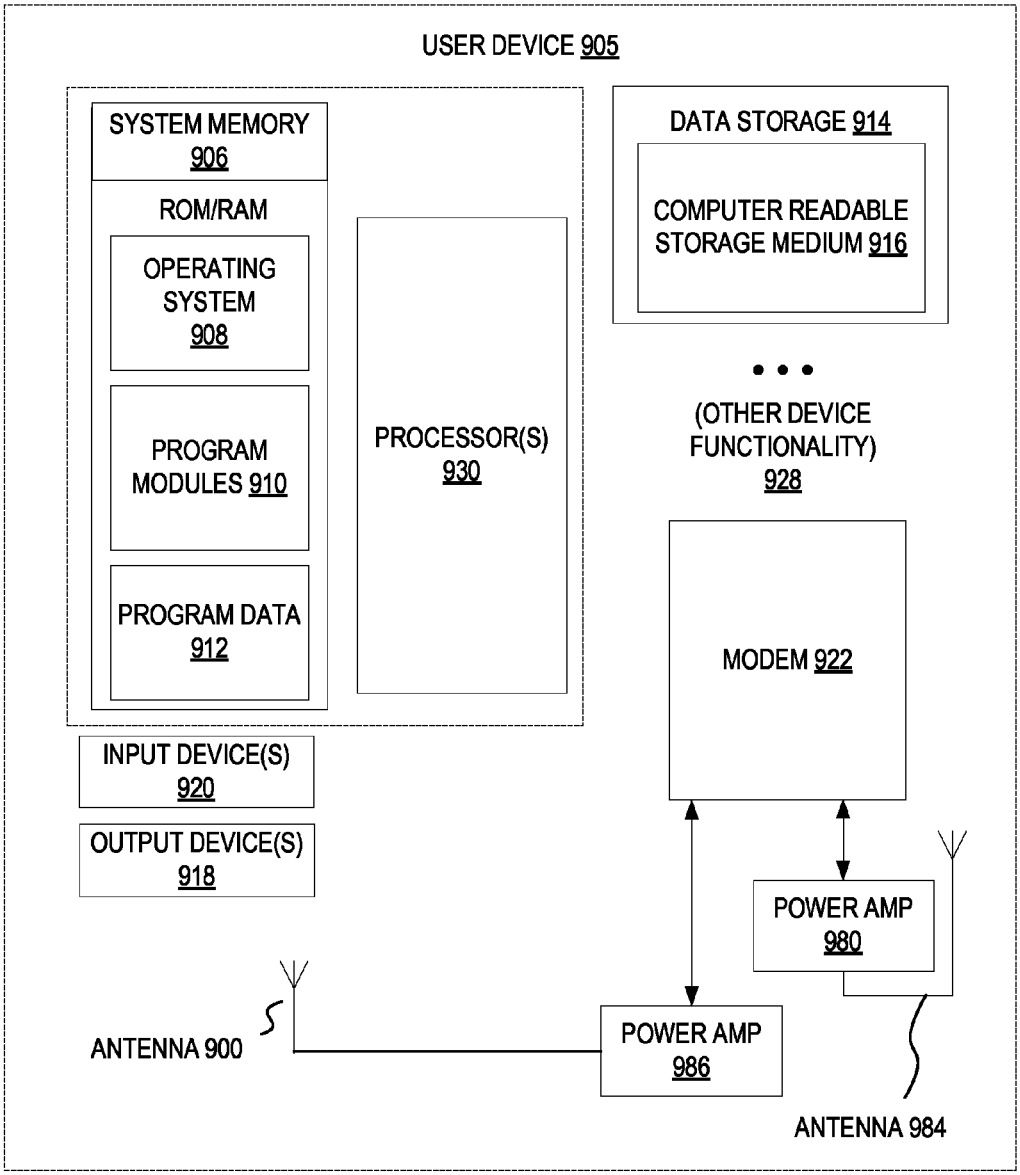
FIG. 9 is a block diagram of a user device having one of the antenna structures described herein, according to one embodiment.

FIG. 9 is a block diagram of a user device having an antenna 900 according to one embodiment. The antenna 900 may have one of the antenna structures described herein, such as the multi-band antenna structure 100. The user device 905 includes one or more processors 930, such as one or more CPUs, microcontrollers, field programmable gate arrays, or other types of processing devices. The user device 905 also includes system memory 906, which may correspond to any combination of volatile and/or non-volatile storage mechanisms. The system memory 906 stores information, which provides an operating system component 908, various program modules 910, program data 912, and/or other components. The user device 905 performs functions by using the processor(s) 930 to execute instructions provided by the system memory 906.

The user device 905 also includes a data storage device 914 that may be composed of one or more types of removable storage and/or one or more types of non-removable storage. The data storage device 914 includes a computer-readable storage medium 916 on which is stored one or more sets of instructions embodying any one or more of the functions of the user device 905, as described herein. As shown, instructions may reside, completely or at least partially, within the computer readable storage medium 916, system memory 906 and/or within the processor(s) 930 during execution thereof by the user device 905, the system memory 906 and the processor(s) 930 constituting computer-readable media. The user device 905 may also include one or more input devices 920 (keyboard, mouse device, specialized selection keys, etc.) and one or more output devices 918 (displays, printers, audio output mechanisms, etc.).

The user device 905 further includes a wireless modem 922 to allow the user device 905 to communicate via a wireless network (e.g., such as provided by a wireless communication system) with other computing devices, such as remote computers, an item providing system, and so forth. The wireless modem 922 allows the user device 905 to handle both voice and non-voice communications (such as communications for text messages, multimedia messages, media downloads, web browsing, etc.) with a wireless communication system. The wireless modem 922 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1xRTT), evaluation data optimized (EVDO), high-speed downlink packet access (HSDPA), WiFi, etc. In other embodiments, the wireless modem 922 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 905 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 905 to communicate with other devices, such as other user devices, server computing systems, telephone devices, or the like. In addition to wirelessly connecting to a wireless communication system, the user device 905 may also wirelessly connect with other user devices. For example, user device 905 may form a wireless ad hoc (peer-to-peer) network with another user device.

The wireless modem 922 may generate signals and send these signals to power amplifier (amp) 980 or power amp 986 for amplification, after which they are wirelessly transmitted via the antenna 900 or antenna 984, respectively. Although FIG. 8 illustrates power amps 980 and 986, in other embodiments, a transceiver may be used to all the antennas 900 and 984 to transmit and receive. The antenna 984, which is an optional antenna that is separate from the antenna 900, may be any directional, omnidirectional or non-directional antenna in a different frequency band than the frequency bands of the antenna 900. The antenna 984 may also transmit information using different wireless communication protocols than the antenna 900. In addition to sending data, the antenna 900 and the antenna 984 also receive data, which is sent to wireless modem 922 and transferred to processor(s) 930. It should be noted that, in other embodiments, the user device 905 may include more or less components as illustrated in the block diagram of FIG. 9.

In one embodiment, the user device 905 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the antenna 900 that operates at a first frequency band and the second wireless connection is associated with a second resonant mode of the antenna 900 that operates at a second frequency band. In another embodiment, the first wireless connection is associated with the antenna 900 and the second wireless connection is associated with the antenna 984. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 922 is shown to control transmission to both antennas 900 and 984, the user device 905 may alternatively include multiple wireless modems, each of which is configured to transmit/receive data via a different antenna and/or wireless transmission protocol. In addition, the user device 905, while illustrated with two antennas 900 and 984, may include more or fewer antennas in various embodiments.

The user device 905 delivers and/or receives items, upgrades, and/or other information via the network. For example, the user device 905 may download or receive items from an item providing system. The item providing system receives various requests, instructions and other data from the user device 905 via the network. The item providing system may include one or more machines (e.g., one or more server computer systems, routers, gateways, etc.) that have processing and storage capabilities to provide the above functionality. Communication between the item providing system and the user device 905 may be enabled via any communication infrastructure. One example of such an infrastructure includes a combination of a wide area network (WAN) and wireless infrastructure, which allows a user to use the user device 905 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 905.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 905 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 905 may include any type of content rendering devices such as electronic book readers, portable digital assistants, mobile phones, smart phones, laptop computers, portable media players, tablet computers, cameras, video cameras, netbooks, notebooks, desktop computers, gaming consoles, DVD players, media centers, and the like.

Figure 10:
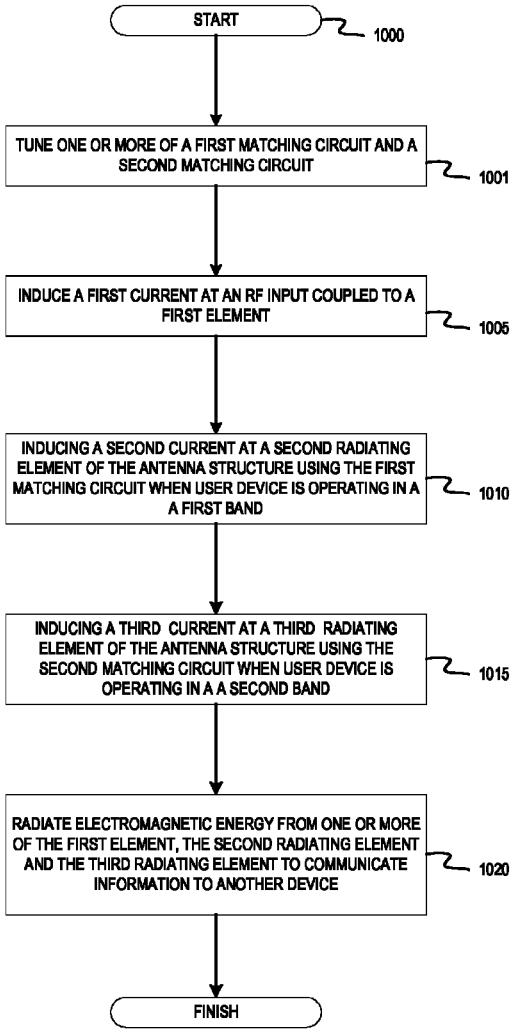
FIG. 10 is a flow diagram of an embodiment of a method of operating a user device having the multi-band antenna structure of FIG. 1 having multiple off-feed matching circuits, according to one embodiment.

FIG. 10 is a flow diagram of an embodiment of a method 1000 of operating a user device having a multi-band antenna structure 100 of FIG. 1 having multiple off-feed matching circuits according to one embodiment. In method 1000, one or more of a first matching circuit and a second matching circuit are tuned at block 1001. For example, a digital capacitor in the first matching circuit may be adjusted to change the capacitance of the digital capacitor. In one embodiment, the first matching circuit and/or the second matching circuit may be tuned based on a desired resonant mode (e.g., a desired frequency). In another embodiment, block 1001 may be optional. For example, if the first matching circuit and the second matching circuit do not include tunable matching components (e.g., contain fixed or static components), the matching circuits may not be tuned. A first current is induced at a single radio frequency (RF) input coupled to a first element of the multi-band antenna structure (block 1005). In response, the first element induces a second current at a second radiating element of the multi-band antenna structure using the first matching circuit when the user device is operating in a first band (block 1010). The first element may also induce a third current at a third radiating element of the multi-band antenna structure using the second matching circuit when the user device is operating in a second band (block 1015). In one embodiment, the second current may be parasitically induced on the second radiating element. In another embodiment, the third current may be parasitically induced on the third radiating element. In one embodiment, the second current may be directly induced on the second radiating element. In another embodiment, the third current may be directly induced on the third radiating element. In response to the induced currents, electromagnetic energy is radiated from the one or more of the second radiating element and the third radiating element to communicate information to another device (block 1020). The electromagnetic energy forms a radiation pattern. The radiation pattern may be various shapes as would be appreciated by one of ordinary skill in the art having the benefit of this disclosure.

The method 1000 may be performed using other multi-band antenna structures. For example, other multi-band antenna structures may include different number of combinations of parasitic antenna elements or conductively coupled antenna elements. Other multi-band antenna structures may also include different numbers of matching circuits. For example, a multi-band antenna my have three radiating antenna elements with one matching circuit for the first radiating element, and one matching circuit for the remaining two radiating elements. Thus, additional currents (e.g., a fourth current, a fifth current) may be induced on additional antenna elements (e.g., a fourth radiating element) using additional matching circuits (e.g., a third matching circuit).

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "transmitting," "sending," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A user device comprising:

a ground plane;

a modem; and a multi-band antenna disposed on an antenna carrier and configured to radiate electromagnetic energy to communicate data to and from the modem via a radio frequency (RF) feed coupled to the modem, wherein the multi-band antenna comprises:

a first parasitic antenna element coupled to the ground plane and not conductively coupled to the RF feed;

a first matching circuit comprising first tunable components, the first matching circuit conductively coupled between the ground plane and the first parasitic antenna element;

a second antenna element conductively coupled to the RF feed, wherein the second antenna element is configured to operate as a feeding structure to the first parasitic antenna element;

a third antenna element coupled to the second antenna element; and a second matching circuit comprising second tunable components, the second matching circuit conductively coupled between the second antenna element and the third antenna element.

2. The user device of claim 1, wherein the antenna carrier has a three-dimensional structure and wherein the first parasitic element comprises a first portion disposed on at least one surface of the antenna carrier and a meandering ground line, wherein the meandering ground line is coupled between the first portion and the ground plane at a first location where the first matching circuit is located.

3. The user device of claim 1, wherein the antenna carrier has a three-dimensional structure and wherein the third antenna element comprises a first portion disposed on at least one surface of the antenna carrier and a coupling line, the coupling line coupled between the first portion and a second location where the second matching circuit is located.

4. The user device of claim 1, wherein the second antenna element comprises a first arm and a second arm, wherein the antenna carrier has a three-dimensional structure, wherein the first arm comprises a first portion that extends from the RF feed in a first direction until a first bend and extends from the first bend towards a surface of the antenna carrier until a second bend, and wherein the second arm comprises a second portion that extends from the second bend towards the ground plane until a third bend and extends from the third bend to the surface of the antenna carrier.

5. The user device of claim 4, wherein the first parasitic element comprises a base portion and a third arm, wherein the third arm extends from the base portion towards the second antenna element, the third arm is disposed substantially parallel to the second arm and in relation to the first arm to form a coupling between the first parasitic antenna element and the second antenna element.

6. A multi-band antenna structure comprising:

a first excitation element conductively coupled to a radio frequency (RF) feed at a first location;

a first radiating element, wherein the first radiating element is configured to radiate electromagnetic energy in a first band, wherein the first radiating element is a parasitic grounding element coupled to a ground plane;

a second radiating element, wherein the second radiating element is configured to radiate electromagnetic energy in a second band, wherein the second radiating element is a driven element conductive coupled to the first excitation element, and wherein the first excitation element is configured to operate as a feeding structure to the first radiating element;

a first matching circuit coupled to the first radiating element at a second location, wherein the first matching circuit comprises a first set of one or more tunable components to tune the first band independently from the second band; and a second matching circuit coupled to the second radiating element at a third location, wherein the second matching circuit comprises a second set of one or more tunable components to tune the second band independently from the first band.

7. The multi-band antenna structure of claim 6, wherein the first matching circuit is disposed at the second location between the first radiating element and the ground plane.

8. The multi-band antenna structure of claim 6, wherein the second radiating element is a T-monopole antenna.

9. The multi-band antenna structure of claim 6, wherein the first matching circuit is disposed at the third location between the second radiating element and the first excitation element.

10. The multi-band antenna structure of claim 6, wherein the first set of tunable components comprises at least one of a resistor, an inductor, a capacitor, a transmission line, a tunable capacitor, a tunable switch, or a tunable inductor.

11. The multi-band antenna structure of claim 6, wherein the second set of tunable components comprises at least one of a resistor, an inductor, a capacitor, a transmission line, a tunable capacitor, a tunable switch, or a tunable inductor.

12. The multi-band antenna structure of claim 6, wherein the first matching circuit and the second matching circuit are not disposed on a feed line coupled between a modem to the RF feed.

13. The multi-band antenna structure of claim 6, wherein the first band comprises frequencies between about 700 MHz and about 960 MHz and wherein the second band comprises frequencies between about 1.71 GHz and about 2.7 GHz.

14. The multi-band antenna of claim 6, wherein each of the first radiating element and the second radiating element is at least one of a monopole antenna, a loop antenna, a dipole antenna, an inverted-F antenna, or a planar inverted-F antenna.

15. A multi-band antenna structure comprising:

a first excitation element conductively coupled to a radio frequency (RF) feed at a first location:

a first radiating element, wherein the first radiating element is configured to radiate electromagnetic energy in a first band;

a second radiating element, wherein the second radiating element is configured to radiate electromagnetic energy in a second band, and wherein the first excitation element is configured to operate as a feeding structure to the first radiating element;

a first matching circuit coupled to the first radiating element at a second location, wherein the first matching circuit comprises a first set of one or more tunable components to tune the first band independently from the second band; and a second matching circuit coupled to the second radiating element at a third location, wherein the second matching circuit comprises a second set of one or more tunable components to tune the second band independently from the first band, wherein the multi-band antenna structure is disposed on an antenna carrier and wherein one or more portions of at least the first radiating element or the second radiating element is disposed on at least two surfaces of the antenna carrier.

16. The multi-band antenna structure of claim 15, wherein the first band comprises frequencies between about 700 MHz and about 960 MHz and wherein the second band comprises frequencies between about 1.71 GHz and about 2.7 GHz.

17. The multi-band antenna of claim 15, wherein the first radiating element is at least one of a monopole antenna, a loop antenna, an inverted-F antenna, or a planar inverted-F antenna.

18. The multi-band antenna of claim 15, wherein the first radiating element comprises a base portion and a first arm, wherein the first arm extends from the base portion towards the first excitation element, the first arm is disposed substantially parallel to a second arm of the first radiating element to form a coupling between the first radiating antenna element and the first excitation element.

19. The multi-band antenna of claim 18, wherein the first radiating element further comprises a meandering ground line coupled between the base portion and the first matching circuit, wherein the first matching circuit is disposed at the second location between the first radiating element and a ground plane.

20. A method of operating a user device, the method comprising:

conductively inducing a first current at a radio frequency (RF) input coupled to a first excitation element of an antenna structure, wherein the antenna structure further comprises a first radiating element, a second radiating element, a first matching circuit coupled to the first radiating element, and a second matching circuit coupled to the second radiating element;

in response to the conductively inducing the first current, parasitically inducing a second current at the first radiating element of the antenna structure using the first matching circuit when the user device is operating in a first band;

in response to the conductively inducing the first current, conductively inducing a third current at the second radiating element of the antenna structure using the second matching circuit when the user device is operating in a second band; and radiating electromagnetic energy from the antenna structure to communicate information to another device in response to the first current and at least one of the second current and the third current.

21. The method of claim 20, wherein the first band comprises frequencies between about 700 MHz and about 960 MHz and wherein the second band comprises frequencies between about 1.71 GHz and about 2.7 GHz.

22. The method of claim 20, further comprising tuning at least one of the first matching circuit or the second matching circuit.

* * * * *